US011231147B2

(12) United States Patent
Cao et al.

(10) Patent No.: US 11,231,147 B2
(45) Date of Patent: Jan. 25, 2022

(54) LIGHT BULB APPARATUS HAVING A TWISTED LED FILAMENT FOR IMPROVED LUMINOUS EFFICIENCY AND LIGHT DISTRIBUTION

(71) Applicant: XIAMEN LEEDARSON LIGHTING CO., LTD, Fujian (CN)

(72) Inventors: Liangliang Cao, Fujian (CN); Yuxin Huang, Fujian (CN); Yongshu Zheng, Fujian (CN)

(73) Assignee: XIAMEN LEEDARSON LIGHTING CO., LTD, Xiamen (CN)

( * ) Notice: Subject to any disclaimer, the term of this patent is extended or adjusted under 35 U.S.C. 154(b) by 0 days.

(21) Appl. No.: 17/150,592

(22) Filed: Jan. 15, 2021

(65) Prior Publication Data

US 2021/0215301 A1 Jul. 15, 2021

(30) Foreign Application Priority Data

Jan. 15, 2020 (CN) ..... 202020082246.9

(51) Int. Cl.

| | |
|---|---|
| ***F21K 9/232*** | (2016.01) |
| ***F21K 9/238*** | (2016.01) |
| ***H05B 45/30*** | (2020.01) |
| ***F21K 9/66*** | (2016.01) |
| *F21Y 113/13* | (2016.01) |
| *F21Y 115/10* | (2016.01) |

(52) U.S. Cl.

CPC ..... *F21K 9/232* (2016.08); *F21K 9/238* (2016.08); *F21K 9/66* (2016.08); *H05B 45/30* (2020.01); *F21Y 2113/13* (2016.08); *F21Y 2115/10* (2016.08)

(58) Field of Classification Search

CPC . F21K 9/232; F21K 9/238; F21K 9/66; H05B 45/30; F21Y 2113/13; F21Y 2115/10

See application file for complete search history.

(56) References Cited

U.S. PATENT DOCUMENTS

| | | | | |
|---|---|---|---|---|
| 10,690,292 | B1 * | 6/2020 | Cao | F21V 29/70 |
| 10,767,816 | B1 * | 9/2020 | Wu | F21K 9/232 |
| 11,015,764 | B2 * | 5/2021 | Jiang | F21K 9/61 |
| 11,015,765 | B2 * | 5/2021 | Van Bommel | F21K 9/61 |
| 11,047,532 | B1 * | 6/2021 | Chen | F21K 9/232 |
| 11,085,591 | B2 * | 8/2021 | Jiang | H05B 45/3574 |

* cited by examiner

*Primary Examiner* — Tracie Y Green

(74) *Attorney, Agent, or Firm* — Chun-Ming Shih; Lanway IPR Services

(57) ABSTRACT

A light bulb apparatus includes a bulb shell, a flexible filament, a driver circuit and a bulb cap. The bulb shell has a top area and a lateral area. The flexible filament has a top portion and a lateral portion. The flexible filament is twisted as a spiral shape. More than 50% of a first light emitted from the lateral portion passes through the lateral area. More than 50% of a second light emitted from the top portion passes through the top area of the bulb shell. The driver circuit converts an external power source to a driving current supplied to the flexible filament. The bulb cap encloses the driver circuit for connecting to the external power source. The top area of the bulb shell and the bulb cap are located at two opposite sides of the lateral area of the bulb shell.

20 Claims, 14 Drawing Sheets

LIGHT BULB APPARATUS HAVING A TWISTED LED FILAMENT FOR IMPROVED LUMINOUS EFFICIENCY AND LIGHT DISTRIBUTION

FIELD

The present invention is related to a light bulb apparatus, and more particularly related to a light bulb apparatus with a linear light source.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

Light bulb devices are widely used in various places. Sometimes, light bulb devices are required to meet desired appearance to be used in decoration applications.

For example, filament bulb devices with LED filaments are used to replace traditional light bulbs with linear light emitting strips.

However, it is important to meet other requirements to produce a useful light bulb devices, e.g. light efficiency and light distribution on different directions. For example, if most light is emitted to lateral side of a light bulb device, the light bulb device may fail to meet government energy efficiency standards.

In addition, assembly is also an important factor to consider when designing a nice bulb device.

Therefore, it is beneficial to design a light bulb device meeting multiple needs.

SUMMARY

In some embodiments, a light bulb apparatus includes a bulb shell, a flexible filament, a driver circuit and a bulb cap.

The bulb shell has a top area and a lateral area.

The flexible filament has a top portion and a lateral portion.

The flexible filament is twisted as a spiral shape.

More than 50% of a first light emitted from the lateral portion passes through the lateral area.

More than 50% of a second light emitted from the top portion passes through the top area of the bulb shell.

The driver circuit converts an external power source to a driving current supplied to the flexible filament.

The bulb cap encloses the driver circuit for connecting to the external power source.

The top area of the bulb shell and the bulb cap are located at two opposite sides of the lateral area of the bulb shell.

In some embodiments, the light bulb apparatus may also include a central column extended from the bulb cap.

The spiral shape encloses the central column.

In some embodiments, the light bulb apparatus may also include a conductive wire extended from the bulb cap for routing the driving current to the flexible filament.

In some embodiments, the bulb cap has a glass base.

The central column and the conductive wire are extended from the glass base toward the bulb shell.

The conductive wire has a top part, a middle part and a bottom part.

The middle part is embedded in the glass base.

The top part engages the flexible filament, and the bottom part engages the driver circuit.

In some embodiments, the middle part is made of a first material other than the top part and the bottom part.

In some embodiments, a conductive wire is partially embedded in the central column.

In some embodiments, the light bulb apparatus may also include a second light source for emitting a supplemental light toward the top portion of the bulb shell.

In some embodiments, the second light source is placed at a top end of the central column.

The top portion of the flexible filament is connected to the top end of the second light source.

In some embodiments, the central column is transparent.

The supplemental light is escaped from the central column.

In some embodiments, the top portion of the flexible filament has a different color temperature than the lateral portion of the flexible filament.

In some embodiments, the top portion of the flexible filament has a larger light intensity per area than the lateral portion of the flexible filament.

In some embodiments, the top area of the bulb shell has a diffusion layer and the lateral area of the bulb shell is kept transparent.

In some embodiments, the top portion of the flexible filament is a separate unit buckled to the lateral portion of the flexible filament.

In some embodiments, when the flexible filament is flatten, the top portion has a circular shape and the lateral portion has a straight line segment shape.

In some embodiments, when the flexible filament is flatten, the top portion and the lateral portion each has a straight line segment shape, and there is an obtuse angle between the top portion and the lateral portion of the flexible filament.

In some embodiments, when the flexible filament is flatten, the top portion has a different main light output direction from the lateral portion of the flexible filament.

In some embodiments, the flexible filament has multiple segments.

Each segment has multiple light emitting directions.

The driver circuit adjusts a relative intensity ratio among the multiple light emitting directions for the multiple segments to generate a desired output light pattern.

In some embodiments, the driver circuit controls a first intensity of the top portion and a second intensity of the lateral portion of the flexible filament to achieve a required three-dimensional light distribution.

In some embodiments, where the top portion and the lateral portion of the flexible filament each includes multiple LED modules.

A first LED arrangement intensity is of the top portion is larger than a second LED arrangement intensity of the lateral portion.

In some embodiments, there is a reflective ring layer disposed on the lateral area close to the bulb cap to reflect a portion of the second light toward the top area of the bulb shell.

DETAILED DESCRIPTION

In some embodiments, a light bulb apparatus includes a bulb shell 8801, a flexible filament 8802, a driver circuit 8808 and a bulb cap 8807.

The bulb shell 8801 has a top area 8809 and a lateral area 8810.

The flexible filament 8802 has a top portion 8804 and a lateral portion 8803.

Figure 3:
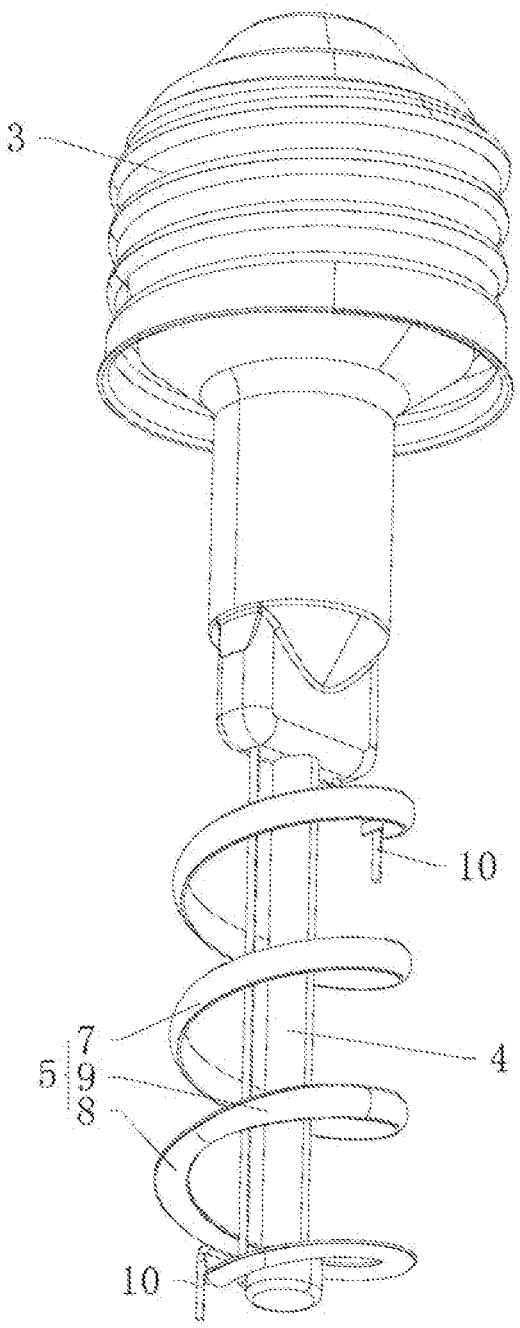
FIG. 3 illustrates a component in the example of FIG. 1.
Figure 9:
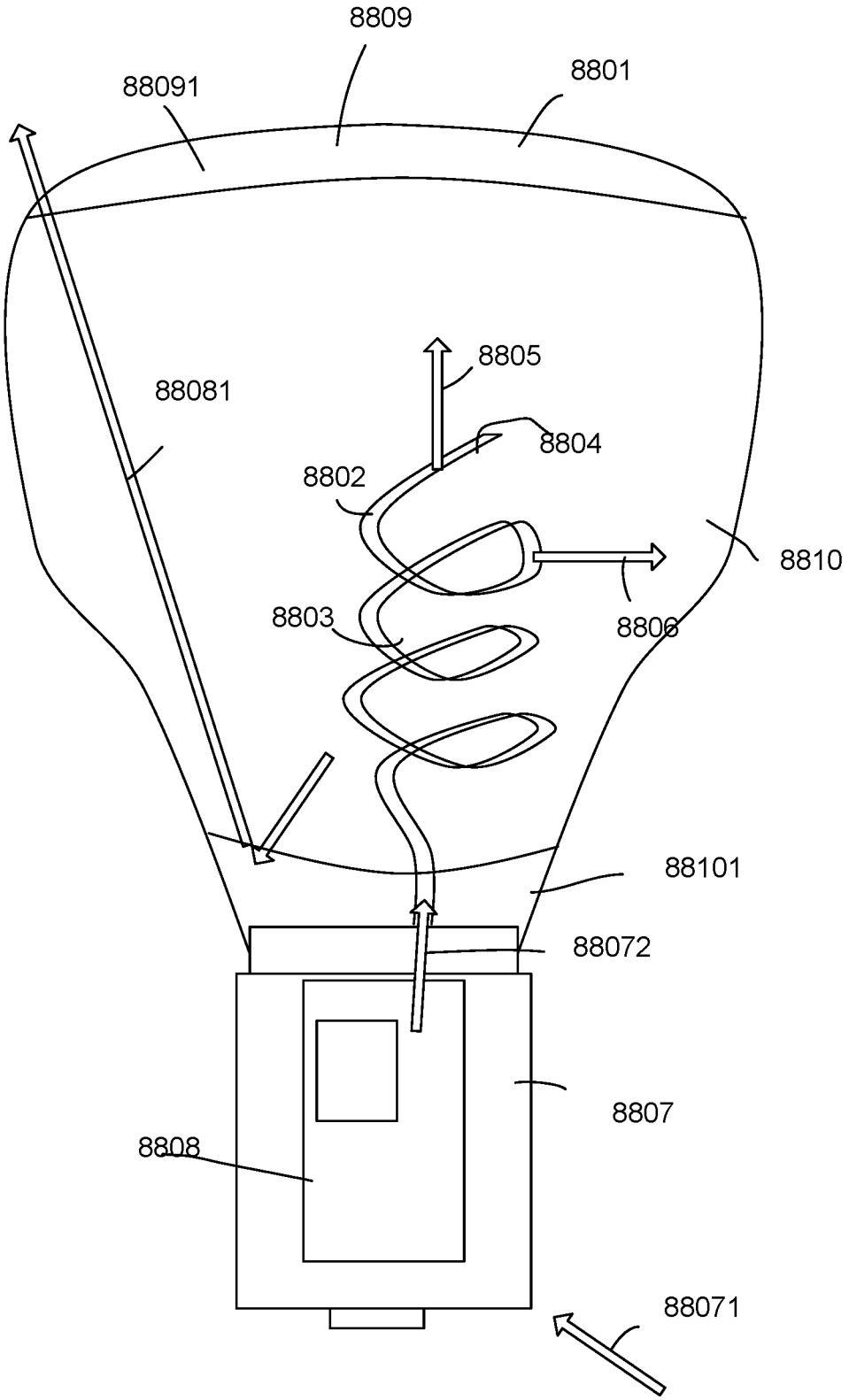
FIG. 9 illustrates an embodiment of a light bulb apparatus.

The flexible filament 8802 is twisted as a spiral shape, as shown in FIG. 9 and FIG. 3.

More than 50% of a first light 8806 emitted from the lateral portion 8803 passes through the lateral area 8810. Specifically, the flexible filament may include multiple LED modules. Each LED module may have a major light emitting direction. Most light, e.g. 50%-90%, is distributed spanning the major light emitting direction.

In some embodiments, the major light emitting direction of the lateral portion 8803 is disposed outwardly facing to the lateral area 8810 of the bulb shell 8801.

More than 50% of a second light 8805 emitted from the top portion 8804 passes through the top area 8809 of the bulb shell 8801. Similarly, the top portion 8804 of the flexible filament is disposed so that the major light emitting direction faces upwardly to the top area 8809 of the bulb shell 8801.

The driver circuit 8808 converts an external power source 88071 to a driving current 88072 supplied to the flexible filament 8802.

The bulb cap 8807 encloses the driver circuit 8808 for connecting to the external power source 88071.

The top area 8809 of the bulb shell 8801 and the bulb cap 8807 are located at two opposite sides of the lateral area 8810 of the bulb shell 8801.

Figure 11:
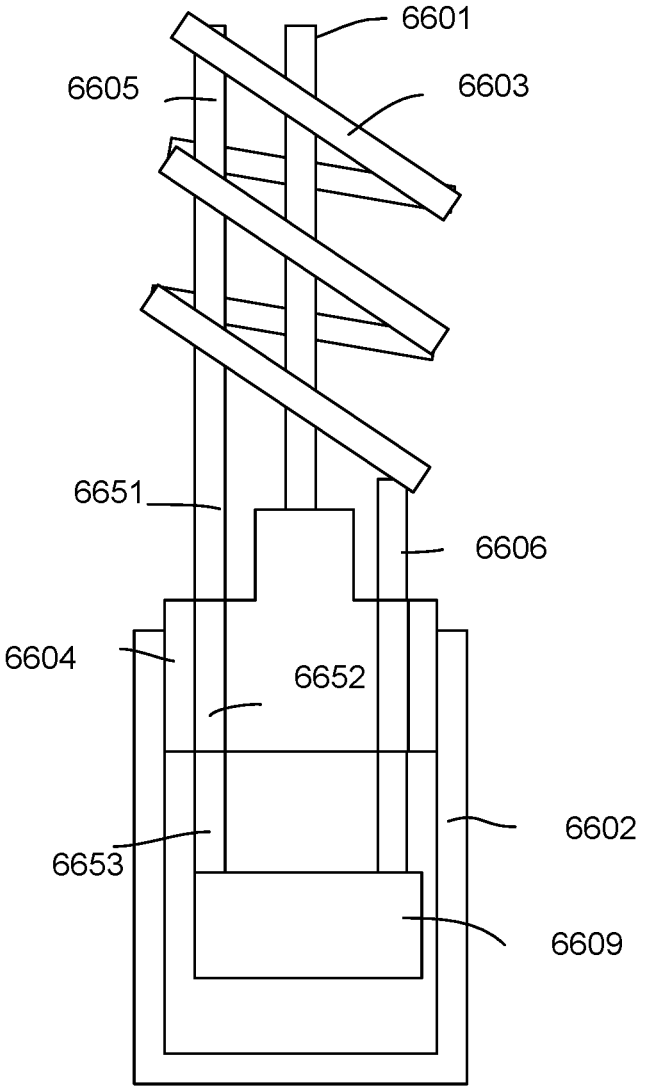
FIG. 11 shows component relation in an embodiment.

In FIG. 11, the light bulb apparatus may also include a central column 6601 extended from the bulb cap 6602.

The spiral shape of the flexible filament 6603 encloses the central column 6601.

In FIG. 11, the light bulb apparatus may also include two conductive wires 6605, 6606 extended from the bulb cap 6602 for routing the driving current to the flexible filament 6603.

In some embodiments, the bulb cap has a glass base 6604.

The central column 6601 and the conductive wires 6605, 6606 are extended from the glass base 6604 toward the bulb shell, toward a page top of the example of FIG. 11.

The conductive wire 665 has a top part 6651, a middle part 6652 and a bottom part 6653.

The middle part 6652 is embedded in the glass base 6604.

The top part 6605 engages the flexible filament 6603, and the bottom part 6653 engages the driver circuit 6609.

In some embodiments, the middle part 6652 is made of a first material other than the top part 6651 and the bottom part 6653. Specifically, the middle part 6652 is to be embedded by the glass base 6604. The material of the middle 6652 may be selected as an alloy material, like a Dumet wire, to resist thermal expansion when being embedded inside the glass base 6604.

Figure 12:
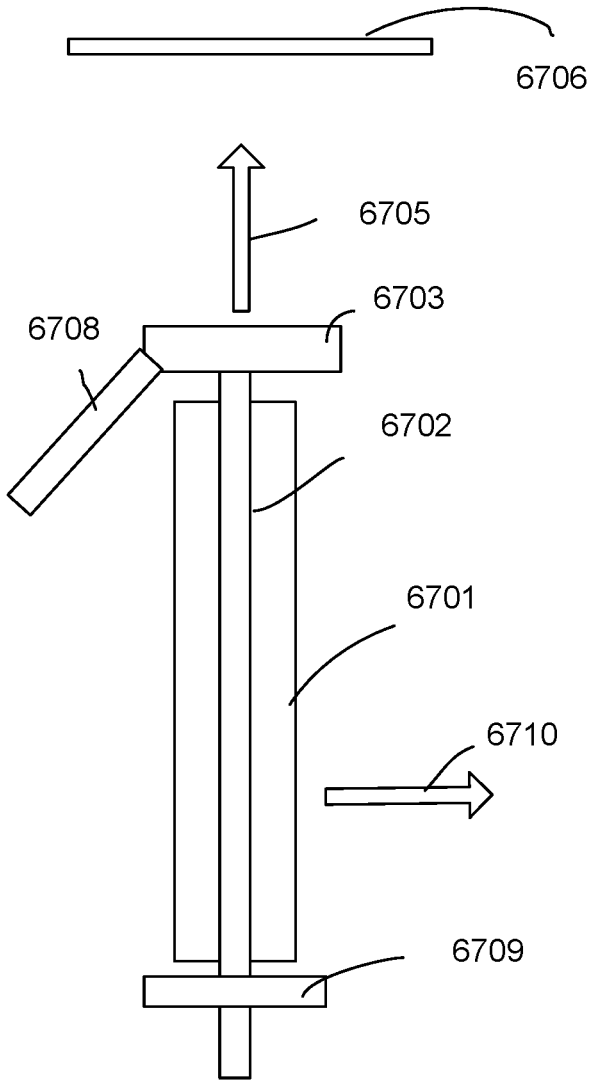
FIG. 12 shows component relation in another embodiment.
Figure 13:
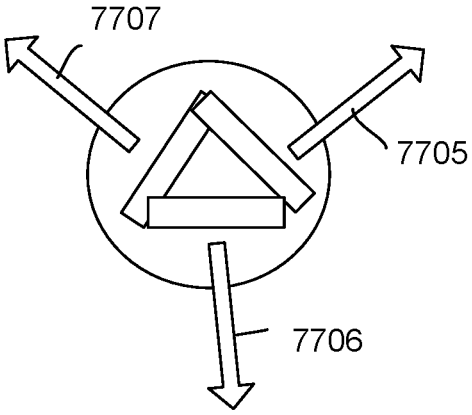
FIG. 13 shows a flexible filament with multiple light directions for each segment.

In FIG. 12, a conductive wire 6702 is partially embedded in the central column 6701. Specifically, there is a hole for placing the conductive wire 6702. The conductive wire 6702 may be used for routing electricity to the flexible filament mentioned above.

In FIG. 12, the light bulb apparatus may also include a second light source 6703 for emitting a supplemental light 6705 toward the top portion 6706 of the bulb shell.

In some embodiments, the second light source 6705 is placed at a top end of the central column.

The top portion 6708 of the flexible filament is connected to the top end of the second light source 6703. For example, the second light source 6703 may have a socket for plugging the top portion 6608 of the flexible filament.

In some embodiments, the central column 6701 is transparent.

The supplemental light 6710 is escaped from the central column 6701, when another second light source 6709 is placed below the central column and emits light into the central column, which may be made of glass material or a light guide. Either the second light source 6703 and the second light source 6709 may be selected to be placed.

In some embodiments, the top portion of the flexible filament has a different color temperature than the lateral portion of the flexible filament. Different colors may also be chosen for generating different appearance. Specifically, people want to see the spiral shape emitting a light but they may want an orange color of the spiral shape in the lateral portion of the flexible filament, while a different color at the top portion of the flexible filament.

In some embodiments, the top portion of the flexible filament has a larger light intensity per area than the lateral portion of the flexible filament. For example, a different light intensity per 1 cm×1 cm is arranged at the top portion of the flexible filament from the light intensity per 1 cm×1 cm at the lateral portion of the flexible filament.

In FIG. 9, the top area 8809 of the bulb shell 8801 has a diffusion layer 88091 to diffuse light and the lateral area 8810 of the bulb shell 8801 is kept transparent.

Figure 8:
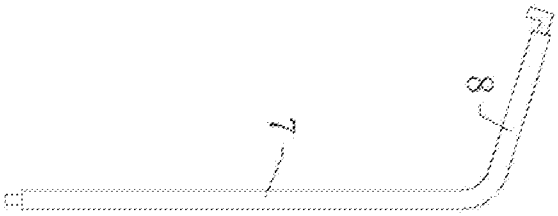
FIG. 8 illustrates another flexible filament example.

In some embodiments, the top portion of the flexible filament is a separate unit buckled to the lateral portion of the flexible filament. For example, the flexible filament example in FIG. 8 shows a flexible filament including a lateral portion 7 and a top portion 8. The lateral portion 7 is buckled to the top portion 8.

Figure 5:
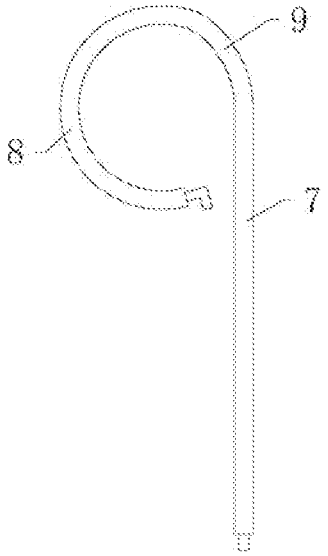
FIG. 5 illustrates a first embodiment of a flexible filament.

In some embodiments, when the flexible filament is flatten, the top portion has a circular shape and the lateral portion has a straight line segment shape. FIG. 5 shows an example of such concept. The flexible filament is flatten and includes a top portion 8 and a lateral portion 7. The top portion 8 has a circular shape connected via a turning part 9 to the lateral portion 7.

In some embodiments, when the flexible filament is flatten, the top portion and the lateral portion each has a straight line segment shape, and there is an obtuse angle between the top portion and the lateral portion of the flexible filament. FIG. 8 shows an example of this concept. In FIG. 8, when the flexible filament is flatten, the flexible filament has a top portion 8 and a lateral portion 7.

Figure 10:
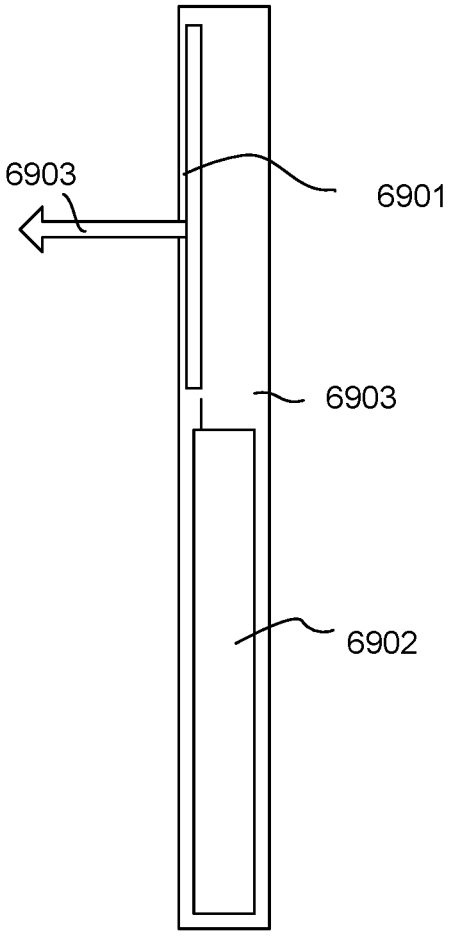
FIG. 10 shows a flexible filament with multiple light emitting directions.

In FIG. 10, when the flexible filament is flatten, the top portion 6901 has a different main light output direction 6903 from the lateral portion 6902 of the flexible filament, which emits light perpendicular to the main light output direction 6903.

Figure 14:
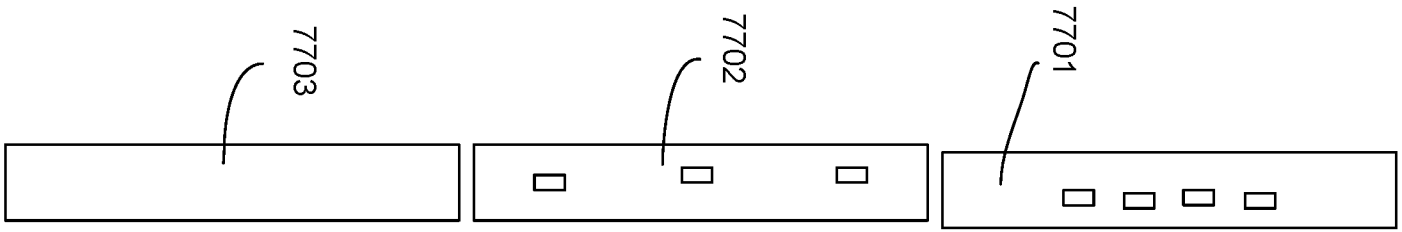
FIG. 14 shows a flexible filament containing multiple segments.

In FIG. 14, the flexible filament has multiple segments 7701, 7702, 7703.

Each segment has multiple light emitting directions 7705, 7706, 7707.

The driver circuit adjusts a relative intensity ratio among the multiple light emitting directions for the multiple segments to generate a desired output light pattern.

In some embodiments, the driver circuit controls a first intensity of the top portion and a second intensity of the lateral portion of the flexible filament to achieve a required three-dimensional light distribution.

A testing machine may be used during manufacturing and determine proper parameters to drive the intensity in different segments and/or different directions.

When the parameters are found, they may be stored in a memory device used by the driver circuit.

In some embodiments, where the top portion and the lateral portion of the flexible filament each includes multiple LED modules.

A first LED arrangement intensity is of the top portion is larger than a second LED arrangement intensity of the lateral portion. For example, FIG. 14 shows that the top portion of the segment 7701 has four LED modules while the segment 7702 in the lateral portion has only three LED modules. Different LED arrangement intensities are disposed.

In FIG. 9, there is a reflective ring layer 88101 disposed on the lateral area 8810 close to the bulb cap 8807 to reflect a portion of the second light 88081 toward the top area 8809 of the bulb shell 8801.

Figure 1:
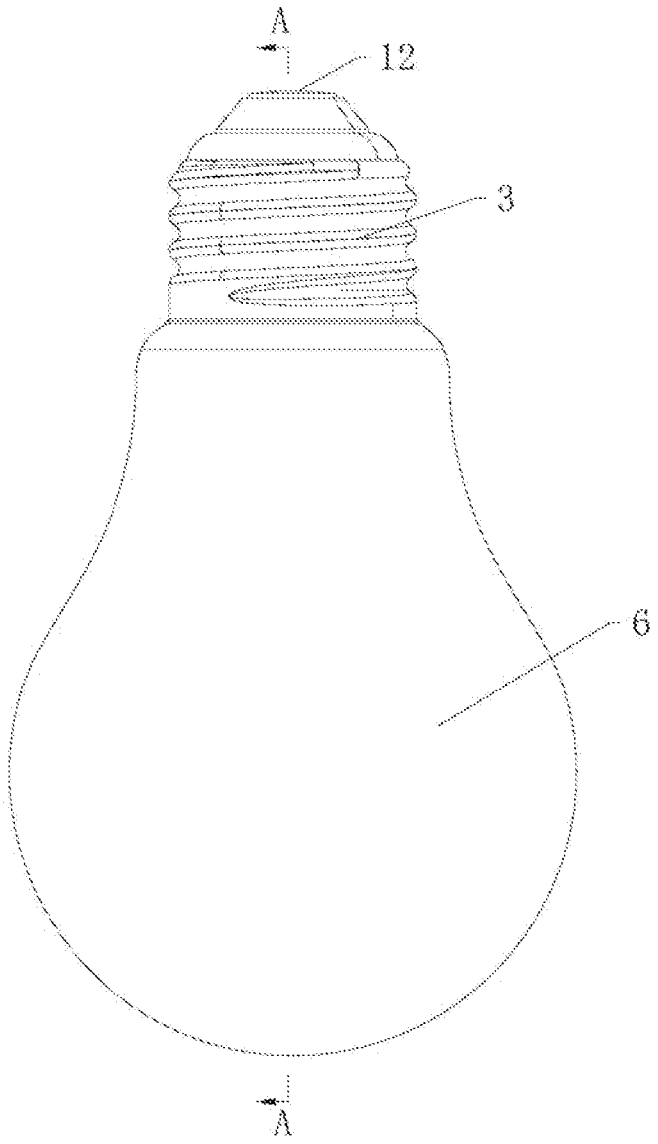
FIG. 1 illustrates a light bulb example.

Please refer to FIG. 1. FIG. 1 shows an embodiment of a light bulb apparatus.

In FIG. 1, the embodiment includes a cap terminal 12 disposed to a bulb cap 3. There is a bulb shell 6 connected to the bulb cap 3 forming a container space for enclosing a flexible filament. Please be noted that there may be more than one flexible filaments that may be twisted together for mixing a desired color temperature or color.

Figure 2:
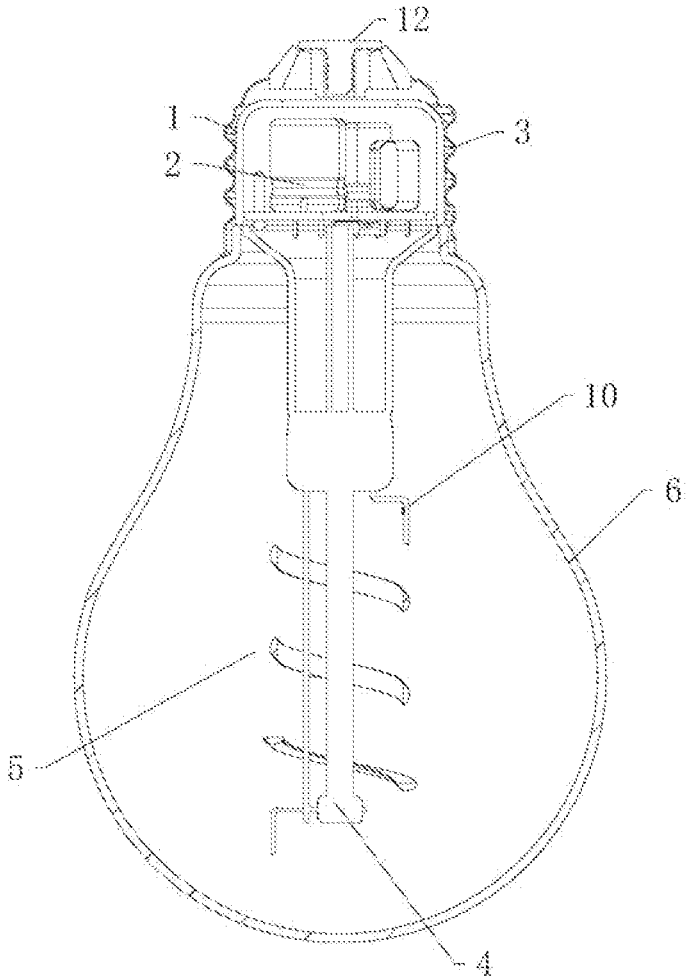
FIG. 2 illustrates a cross-sectional view of the example in FIG. 1.

Please refer to FIG. 2, which shows a cross-sectional view of the example in FIG. 1. There is a conductive wire 10 for routing a driving current to the flexible filament 5 so as to emit light passing through the bulb shell 6. There is a driver circuit 2 enclosed by an insulation housing 1 of the bulb cap 3. There is a central column 4 which may be made of glass material extended from a glass base fixed to the bulb cap 3.

Please refer to FIG. 3. The flexible filament 5 has a lateral portion 7, a top portion 8 and a connector portion 9 for connecting the top portion 8 and the lateral portion 7. Other components already mentioned are not repeated again for brevity and it is the same in the following disclosure.

Figure 4:
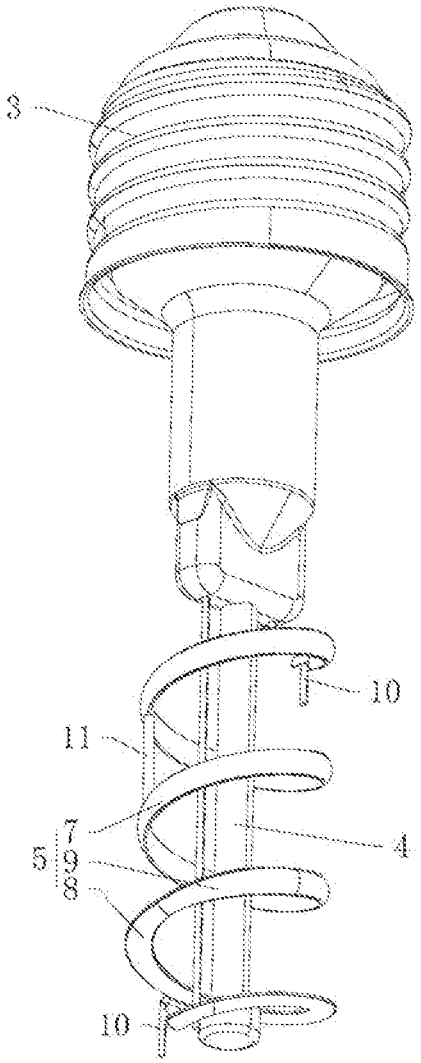
FIG. 4 illustrates another example to be used in the example of FIG. 1.

FIG. 4 shows a different embodiment, in which a support bracket 11 is disposed for ensuing the flexible filament to keep a predetermined shape.

FIG. 5 shows a flexible filament example, which is explained above.

Figure 6:
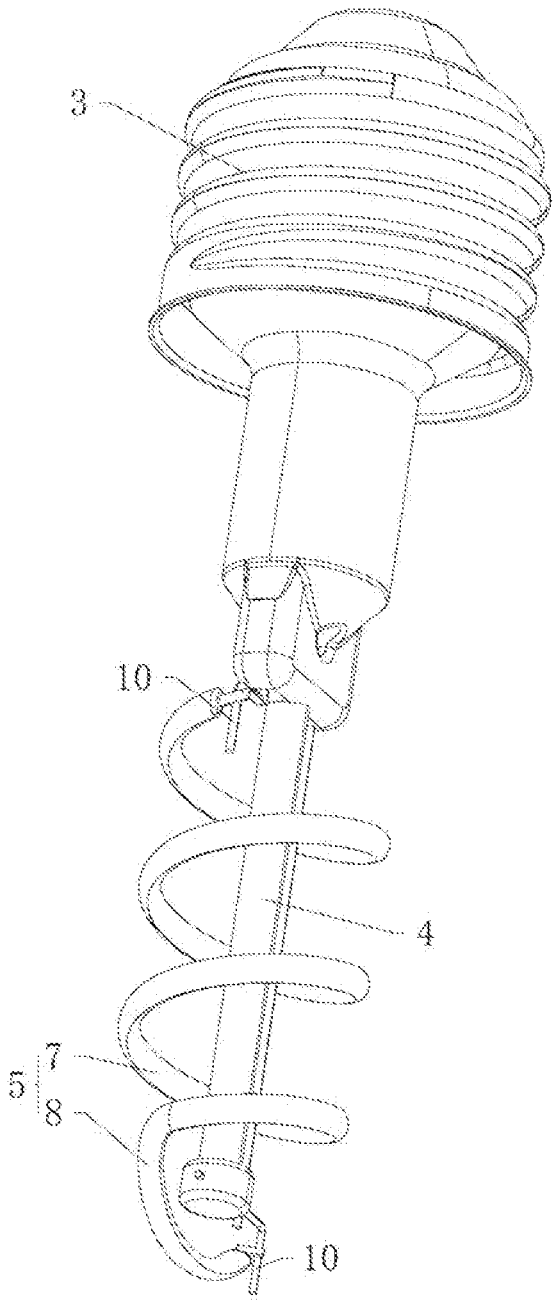
FIG. 6 illustrates another light bulb filament component example.

FIG. 6 shows another embodiment with a different top portion 8 of the flexible filament 5.

Figure 7:
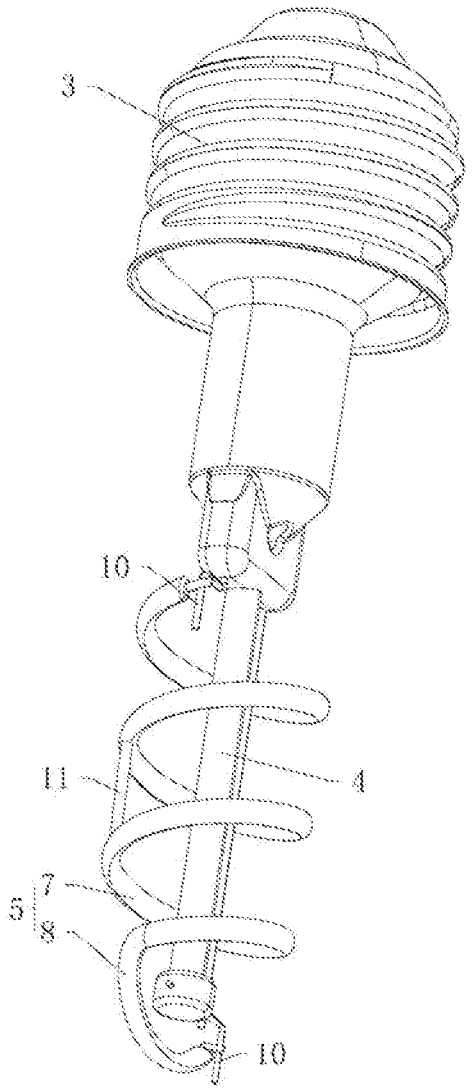
FIG. 7 illustrates a variation of the example in FIG. 6.

FIG. 7 shows another embodiment with an additional support bracket 11 to keep the shape of the flexible filament 5.

FIG. 8 shows another example of a flexible filament, which is explained in above disclosure.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A light bulb apparatus, comprising:

a bulb shell having a top area and a lateral area;

a flexible filament having a top portion and a lateral portion, wherein the flexible filament is twisted as a spiral shape, more than 50% of a first light emitted from the lateral portion passes through the lateral area, more than 50% of a second light emitted from the top portion passes through the top area of the bulb shell;

a driver circuit for converting an external power source to a driving current supplied to the flexible filament; and a bulb cap enclosing the driver circuit for connecting to the external power source, wherein the top area of the bulb shell and the bulb cap are located at two opposite sides of the lateral area of the bulb shell.

2. The light bulb apparatus of claim 1, further comprising a central column extended from the bulb cap, wherein the spiral shape enclosing the central column.

3. The light bulb apparatus of claim 2, further comprising a conductive wire extended from the bulb cap for routing the driving current to the flexible filament.

4. The light bulb apparatus of claim 3, wherein the bulb cap has a glass base, the central column and the conductive wire are extended from the glass base toward the bulb shell, the conductive wire has a top part, a middle part and a bottom part, the middle part is embedded in the glass base, the top part engages the flexible filament, and the bottom part engages the driver circuit.

5. The light bulb apparatus of claim 4, wherein the middle part is made of a first material other than the top part and the bottom part.

6. The light bulb apparatus of claim 2, wherein a conductive wire is partially embedded in the central column.

7. The light bulb apparatus of claim 2, further comprising a second light source for emitting a supplemental light toward the top portion of the bulb shell.

8. The light bulb apparatus of claim 7, wherein the second light source is placed at a top end of the central column, the top portion of the flexible filament is connected to the top end of the second light source.

9. The light bulb apparatus of claim 7, wherein the central column is transparent, the supplemental light is escaped from the central column.

10. The light bulb apparatus of claim 1, wherein the top portion of the flexible filament has a different color temperature than the lateral portion of the flexible filament.

11. The light bulb apparatus of claim 10, wherein the top portion of the flexible filament has a larger light intensity per area than the lateral portion of the flexible filament.

12. The light bulb apparatus of claim 11, wherein the top area of the bulb shell has a diffusion layer and the lateral area of the bulb shell is kept transparent.

13. The light bulb apparatus of claim 1, wherein the top portion of the flexible filament is a separate unit buckled to the lateral portion of the flexible filament.

14. The light bulb apparatus of claim 1, wherein when the flexible filament is flatten, the top portion has a circular shape and the lateral portion has a straight line segment shape.

15. The light bulb apparatus of claim 1, wherein when the flexible filament is flatten, the top portion and the lateral portion each has a straight line segment shape, and there is an obtuse angle between the top portion and the lateral portion of the flexible filament.

16. The light bulb apparatus of claim 1, wherein when the flexible filament is flatten, the top portion has a different main light output direction from the lateral portion of the flexible filament.

17. The light bulb apparatus of claim 1, wherein the flexible filament has multiple segments, each segment has multiple light emitting directions, the driver circuit adjusts a relative intensity ratio among the multiple light emitting directions for the multiple segments to generate a desired output light pattern.

18. The light bulb apparatus of claim 1, wherein the driver circuit controls a first intensity of the top portion and a second intensity of the lateral portion of the flexible filament to achieve a required three-dimensional light distribution.

19. The light bulb apparatus of claim 1, where the top portion and the lateral portion of the flexible filament each comprises multiple LED modules, a first LED arrangement intensity is of the top portion is larger than a second LED arrangement intensity of the lateral portion.

20. The light bulb apparatus of claim 1, wherein there is a reflective ring layer disposed on the lateral area close to the bulb cap to reflect a portion of the second light toward the top area of the bulb shell.

* * * * *